US011217209B2

(12) United States Patent
Ogi et al.

(10) Patent No.: US 11,217,209 B2
(45) Date of Patent: Jan. 4, 2022

(54) IMAGE PROCESSING APPARATUS, IMAGE PROCESSING SYSTEM AND IMAGE PROCESSING METHOD

(71) Applicant: SCREEN HOLDINGS CO., LTD., Kyoto (JP)

(72) Inventors: Hiroshi Ogi, Kyoto (JP); Sanzo Moriwaki, Kyoto (JP); Tomoyasu Furuta, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 17/148,434

(22) Filed: Jan. 13, 2021

(65) Prior Publication Data

US 2021/0233497 A1 Jul. 29, 2021

(30) Foreign Application Priority Data

Jan. 29, 2020 (JP) ..... JP2020-012483

(51) Int. Cl.
*G09G 5/00* (2006.01)
*G09G 5/36* (2006.01)

(52) U.S. Cl.
CPC ..... *G09G 5/363* (2013.01); *G09G 2340/12* (2013.01)

(58) Field of Classification Search
CPC ..... G06T 11/60; G06T 7/0012; G06T 2207/10056; G06T 2207/20104; G06T 2207/20212; G06T 2207/20221; G06T 2207/30004; G06T 7/62; A61B 5/742; G09G 2340/12; G09G 5/363; G09G 5/37
See application file for complete search history.

(56) References Cited

U.S. PATENT DOCUMENTS

2014/0176602 A1 6/2014 Yoshihara et al.
2014/0193052 A1 7/2014 Yoshihara et al.
2015/0339514 A1* 11/2015 Kiyuna ..... G16H 30/40 382/133

FOREIGN PATENT DOCUMENTS

WO 2013/024600 A1 2/2013
WO 2013/027399 A1 2/2013

* cited by examiner

*Primary Examiner* — Hau H Nguyen
(74) *Attorney, Agent, or Firm* — McDermott Will & Emery LLP

(57) ABSTRACT

An image processing apparatus includes an image acquirer for obtaining an original image of a pathological specimen, an information acquirer for obtaining finding information relating to pathological finding and an image generator for generating an output image including a processed image obtained by superimposing visual information based on the finding information on a source image. A relative density between the source image and the visual information is set according to an operation input from a user. Processing modes for generating the output image include a first mode for generating the output image in which the source image and the processed image are arranged on one screen and a second mode for generating the output image in which a wide range image at a relatively low magnification and an enlarged image representing a partial region in the wide range image at a higher magnification on one screen.

14 Claims, 8 Drawing Sheets

IMAGE PROCESSING APPARATUS, IMAGE PROCESSING SYSTEM AND IMAGE PROCESSING METHOD

CROSS REFERENCE TO RELATED APPLICATION

The disclosure of Japanese Patent Application No. 2020-012483 filed on Jan. 29, 2020 including specification, drawings and claims is incorporated herein by reference in its entirety.

BACKGROUND OF THE INVENTION

1. Field of the Invention

This invention relates to an image processing technique for processing an original image captured by imaging a pathological specimen. Particularly, this invention relates to a technique for supporting a diagnosis by a pathologist by reflecting and presenting pathological findings extracted by an image analysis on a displayed image.

2. Description of the Related Art

At a pathological diagnosis site, a skilled doctor (pathologist) has observed a pathological specimen collected from a patient and diagnosed by comprehensively judging a state of the pathological specimen. Such an operation is a large load on the pathologist and possibly causes a variation in diagnosis result. Thus, the development of a technique for mechanizing and automating this operation has been in progress and many techniques to partially replace a diagnosis operation of a doctor have been proposed. For example, in techniques described in WO 2013/027399 and WO 2013/024600, a part having a specific morphological feature is extracted from an image captured by imaging a pathological specimen by an image analysis and a result quantitatively or statistically evaluating an analysis result is presented.

Particularly in recent years, researches on artificial intelligence and the application thereof have advanced to a practical level. This has enabled even comprehensive judgment, which had to be conventionally made based on experiences by humans and is based on information not necessarily suitable for quantification, to be automated.

However, at the moment, it has not yet reached to automate an entire operation performed by a pathologist for diagnosis, and judgment based on the pathologist's experiences remains to be necessary. Further, in many countries, it is legalized that a final diagnostic action needs to be performed by a doctor.

Many pieces of information including those not suitable for quantification can be obtained from an image of a pathological specimen. However, to which piece of information importance should be placed and evaluation criteria for the important piece of information are still finally left up to the knowledge and experiences of a doctor. Thus, the presentation of quantitative information on some of indices as in the above conventional art cannot be necessarily said to be high in versatility.

Then, it cannot be necessarily said to be effective to present only information quantified as indices on judgment and an automatic judgment result based on this quantified information and judgment criteria determined in advance. At the moment, it is rather more effective in some cases to present many pieces of information obtained from an image as they are without any prejudgment and in various modes in response to a request of a user (doctor) in a multifaceted way. Thus far, the user has obtained pathological findings by observing a specimen image in detail and diagnosed based on that result. If a series of such operations can be supported from the aspect of extracting and presenting pathological findings, a load on a doctor relating to a diagnosis can be drastically reduced and a stable diagnosis can be enabled.

A pathological specimen is generally stained with HE (Hematoxylin and Eosin). This staining method can separately stain cytoplasms and cell nuclei, but is not for selectively staining specific cell species, disease sites and the like. Due to this universality, various pieces of information can be extracted from an image of a stained specimen. On the other hand, deep knowledge is necessary to effectively extract information on a specific disease. By mechanically replacing this operation, it is expected that the user can be dedicated to a diagnosis based on the extracted piece of information and an efficient and stable diagnosis result can be obtained.

An image processing system for supporting a diagnosis operation in a multifaceted way from these perspectives has not been proposed thus far. Specifically, many of conventional techniques focus on features unique to specific cells and diseases and utilize these features, and a range of its application has been restrictive.

SUMMARY OF THE INVENTION

This invention was developed in view of the above problem and an object thereof is to provide a technique capable of effectively supporting a diagnosis operation by a doctor by presenting various pieces of information obtained from an image easily and in a multifaceted way in displaying the image captured by imaging a pathological specimen.

To achieve the above object, one aspect of an image processing apparatus according to this invention includes an image acquirer for obtaining an original image captured by imaging a pathological specimen, an information acquirer for obtaining finding information relating to pathological finding included in the original image for at least one type of the pathological finding, an image generator for, using at least a part of the original image as a source image, generating an output image for screen display including a processed image obtained by superimposing visual information corresponding to the pathological finding specified by the finding information on the source image as an image element, and a receiver for receiving an operation input from a user. Here, the image generator sets a relative density between the source image and the visual information in the processed image according to the operation input and has a plurality of processing modes including a first mode and a second mode for generating the output image, the processing modes being selectable by the operation input.

Further, to achieve the above object, one aspect of an image processing method according to this invention includes obtaining an original image captured by imaging a pathological specimen, obtaining finding information relating to pathological finding in the original image for at least one type of the pathological finding, receiving an operation input from a user, and generating an output image for screen display by using at least a part of the original image as a source image, the output image including a processed image obtained by superimposing visual information representing positions of the pathological finding specified by the finding information on the source image as an image element. Here, a relative density between the source image and the visual information in the processed image is set according to the operation input and a processing mode for generating the output image is selected from a plurality of processing modes including a first mode and a second mode for generating the output images by the operation input.

In these inventions, the plurality of processing modes include a first mode and a second mode. The first mode is the processing mode for generating the output image in which the source image and the processed image having the same field of view are arranged as the image elements on one screen. Further, the second mode is the processing mode for generating the output image in which a wide range image representing at least a partial region of the original image at a relatively low magnification and an enlarged image representing a partial region in the wide range image at a higher magnification than the wide range image are arranged as the image elements on one screen, the magnification of the enlarged image is changeable by the operation input, at least one of the wide range image and the enlarged image is the processed image and a region marker indicating a region corresponding to the enlarged image is superimposed on the wide range image.

Further, to achieve the above object, one aspect of an image processing system according to this invention includes an imaging device for generating the original image by imaging the pathological specimen, an image processing device having the above configuration, and a display device for displaying an image corresponding to the output image output by the image processing device.

In the invention, the "pathological finding" means knowledge obtained by applying an image analysis of extracting parts to be observed to the original image. For example, the "pathological findings" possibly include structures including tissues, cells, organelles and the like and liquids such as blood and interstitial fluid to be observed for a pathological diagnosis, the presence or absence of parts having a specific morphological feature in the original image, quantitative information such as the positions, sizes, number and the like of such parts and the like. In this sense, the pathological finding can be said to be substantially synonymous with "an analysis result obtained by the image analysis of extracting the parts to be observed". Which parts are to be observed are determined according to the type of a disease and the purpose of the diagnosis.

Further, the "visual information" is various pieces of information which enables the user to easily visually recognize a specific region of the source image being the region extracted as the pathological finding and properties and the like of the pathological finding in this region. Modes of the visual information possibly include, for example, color coding, the emphasis of the contour or shading of the region, the attachment of markers by symbols or graphics or character information. These may be combined as appropriate.

In the inventions thus configured, the information on the pathological findings required by the user (doctor who diagnoses) can be easily presented according to a request and effectively support a diagnosis operation. The reason for that is as follows. At a pathological diagnosis site, a pathological specimen is observed from various perspectives and comprehensively diagnosed. Thus, a support method for displaying and presenting various pathological findings extracted from the pathological specimen in various display modes is more desirable than the presentation of only a quantitative evaluation result on a specific pathological finding.

In the first mode of the invention, using at least a part of an original image as a source image, an image including the source image and a processed image obtained by applying a processing based on finding information to the source image as image elements can be displayed. That is, the source image, which is an unprocessed image, and the processed image, which has the same field of view as the source image and to which visual information corresponding to pathological findings are added, are displayed on one screen. In such a display mode, the user can compare and observe the unprocessed source image and an extracted state of the pathological findings in the source image. This is, for example, useful in evaluating the positions, the distributed state, the density and the like of the pathological findings included in the source image.

In the processed image, a relative density between the source image and the visual information superimposed on the source image is changeable by a user operation. It is required to add clear visual information to clearly show the positions of the pathological findings, whereas it may become difficult to understand which structures in the image are regarded as the pathological findings due to the shielding of image contents of the source image by the visual information. By changing the relative density between the both according to the user operation, both the positions of the pathological findings and the image contents at these positions can be clearly shown in a mode desired by the user.

Note that a method for changing the density (luminance) of the source image, a method for changing the density of the visual information and a method for changing the both are available as a method for changing the relative density between the source image and the visual information. Any of these methods may be employed or these methods may be used while being switched as appropriate.

On the other hand, in the second mode of the invention, it is possible to display an image in which a wide range image representing a relatively wide region in the original image at a low magnification and an enlarged image representing a part of a region included in the wide range image at a high magnification are arranged on one screen. The second mode meets a demand in a pathological diagnosis to simultaneously grasp a state around a specimen while observing the details of the specimen. In this case, it is required in some cases to observe while a field of view of the enlarged image is increased or decreased in a stepwise manner. Accordingly, in the invention, a display magnification of the enlarged image can be changed by a user operation. Further, to show a correspondence relationship of the enlarged image and the wide range image, a region marker indicating the region corresponding to the enlarged image in the wide range image is displayed.

Such an image processing as to change a display magnification of an image according to a user operation is common. However, if an enlarged image having a changing display magnification and a wide range image displaying a wide range including the surrounding of the enlarged image at a fixed magnification are displayed on one screen and a region marker clearly showing a correspondence relationship of the both images is displayed, it is possible to meet a demand in a pathological diagnosis to simultaneously confirm a state of the surrounding while observing details at a suitable magnification.

In the image processing device of the invention, the processing mode desired by the user can be selected from those including these two processing modes and performed. Various methods for presenting an image of a specimen added with information useful for a pathological diagnosis have been proposed. However, only a specific display mode is not sufficient for the presentation of information required at a site of a pathological diagnosis comprehensively made from many pieces of information as described above. The invention has a plurality of processing modes covering various display modes required by the user and a variety of demands can be met by appropriately selecting and performing those processing modes.

As described above, the invention can be realized to cover various display modes required at a pathological diagnosis site. Further, in each display mode, an image can be variously changed according to a request of a user (doctor). Thus, various pieces of information obtained from the image can be presented in a mode easily understandable by the user and in a multifaceted way, and a diagnosis operation by the doctor can be effectively supported.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

DETAILED DESCRIPTION OF THE PREFERRED EMBODIMENTS

Figure 1A:
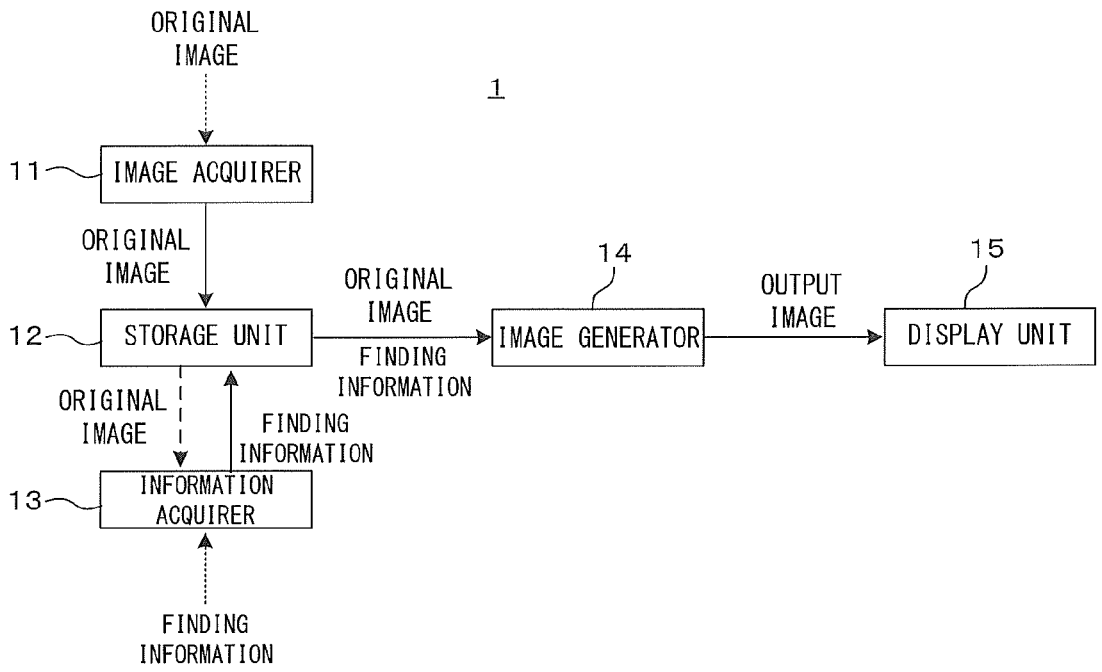
FIGS. 1A and 1B are diagrams showing a schematic configuration of one embodiment of an image processing system according to the invention.
Figure 1B:
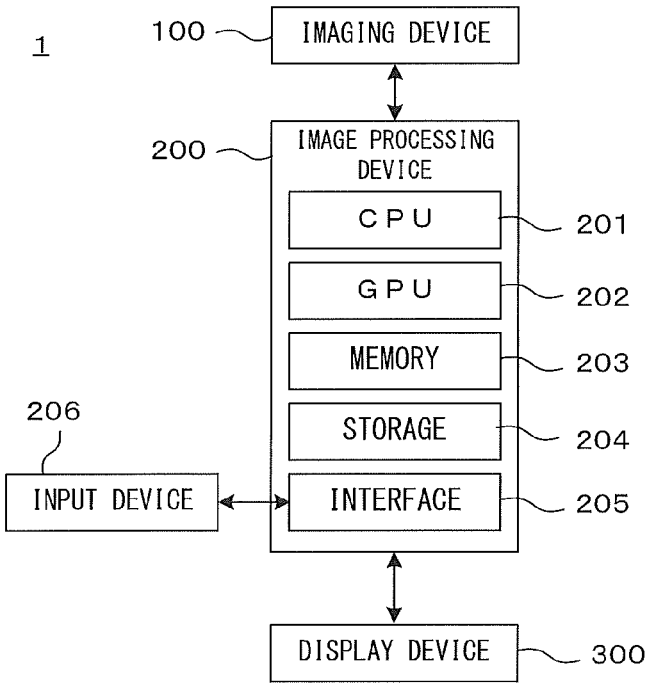

FIGS. 1A and 1B are diagrams showing a schematic configuration of one embodiment of an image processing system according to the invention. More specifically, FIG. 1A is a block diagram conceptually showing functional blocks which should be included in the image processing system 1 to carry out the invention. Further, FIG. 1B is a block diagram showing a more specific hardware configuration. This image processing system 1 is a system for supporting an operation of a user (specifically, a pathologist), who observes and diagnoses a pathological specimen collected from a patient or a subject, from the aspect of an image processing.

This image processing system 1 can be applied to pathologic diagnoses for various diseases in various organs, and application targets thereof are not particularly limited. However, if it is necessary to mention a particularly specific case example in the following description, a pathological diagnosis of a brain tumor based on an image of a pathological specimen is covered as an example. A guideline is provided, for example, in "WHO Classification of Tumours of the Central Nervous System (WHO Health Organization Classification of Tumours), ISBN-13: 978-9283244929, World Health Organization (2016/5/13)" for morphological findings in a pathological diagnosis of a brain tumor.

As shown in FIG. 1A, the image processing system 1 includes various functional blocks of an image acquirer 11, a storage unit 12, an information acquirer 13, an image generator 14 and a display unit 15 as main components thereof.

The image acquirer 11 obtains an original image to be processed in this system. The original image is an image obtained by the bright field imaging of a collected pathological specimen at a predetermined magnification and in a predetermined field size. A size of an imaging field of view is so selected as to include at least one region, preferably a plurality of regions, with a possibility to correspond to a pathological tissue to be observed. Further, an imaging magnification is so selected that a pathological tissue is included in an image with a resolution sufficient to observe the shape and texture of the pathological tissue. For example, since 5× to 40× is often used as a magnification of an objective lens in visual observation using a microscope, imaging magnification is desirably corresponding to an objective lens having a magnification equal to or higher than 40×. An image, so-called a whole slide image, captured by imaging an entire specimen at a high magnification can be suitably utilized as the original image mentioned here.

Generally, a pathological specimen is stained with HE (Hematoxylin and Eosin). This staining method can separately stain cytoplasms and cell nuclei in the specimen, but is not for selectively staining specific cell species, disease sites and the like. In this sense, HE staining can be said to be a universal staining method not biased to a specific purpose. Thus, information on various cell species, diseases and the like can be extracted from an image of the specimen. On the other hand, abundant knowledge is necessary to artificially extract specific structures and parts corresponding to a disease from an image.

The image acquirer 11 may obtain an original image by imaging the pathological specimen itself or may receive data of the original image captured in advance and given from outside as indicated by a dotted-line arrow. The storage unit 12 stores various pieces of data. For example, the storage unit 12 stores original image data corresponding to the original image obtained by the image acquirer 11.

The information acquirer 13 obtains information on pathological findings included in the original image. The "pathological findings" mentioned here mean various pieces of knowledge obtained by applying a computer image analysis of extracting parts having a specific morphological feature in the original image such as structures including tissues, cells, organelles and the like and liquids including blood and interstitial fluid to be observed for a pathological diagnosis to the original image. The pathological findings are qualitatively or quantitatively represented in the form of the types, properties, regions in the original image, positions, sizes and number and the like of such parts or may be represented by a combination of qualitative information and quantitative information indicating a degree of the qualitative information. Which parts are to be observed is determined according to the type of a disease or the purpose of a diagnosis.

Information on the pathological findings possibly includes various pieces of information representing the pathological findings extracted from the original image and the properties thereof, e.g. information quantitatively representing the positions, sizes, number and the like of the pathological findings. The information on these pathological findings may be abbreviated as "finding information" below.

For example, the information representing the positions of the pathological findings can specify regions occupied by the pathological findings in the original image and further indirectly represent the sizes of the pathological findings if this information represents whether or not each position in the original image corresponds to the pathological finding. In that sense, the information representing the positions of the pathological findings is particularly important information.

The information acquirer 13 may extract the pathological findings by analyzing the original image itself and obtain the finding information or may receive information on pathological findings extracted from the original image in advance from outside. The obtained finding information is stored in the storage 12. For example, if the pathological specimen relates to a brain tumor, as the pathological findings useful in diagnosis and constituent elements thereof, blood vessels, calcification, cell division images, necrosis, a level of cell density, a level of nuclear atypia and the like can be used.

Known various image processing methods can be used as a method for analyzing an original image and extracting pathological findings. For example, a feature amount indicating a morphological feature of an object included in an original image can be calculated and regions corresponding to pathological findings can be extracted by an appropriate classification method based on the feature amount. At this time, classification by machine learning using an appropriate learning algorithm may be utilized. Further, an image may be analyzed using a learning model constructed by deep learning. This embodiment is characterized in a display processing and an analysis method is not particularly limited.

The image generator 14 generates image data corresponding to an output image to be displayed on a screen by processing the original image if necessary. In processing the original image, the finding information is referred to if necessary. The display unit 15 displays an output image generated by the image generator 14 and presents the output image to a user.

Such an image processing system 1 can be realized, for example, by a hardware configuration shown in FIG. 1B. In this example, the image processing system 1 includes an imaging device 100, an image processing device 200 and a display device 300. These are electrically connected to each other. The devices may be directly connected as shown in FIG. 1B or may be connected by an electrical communication line such as a LAN (Local Area Network) line or an internet line.

The imaging device 100 has a function of generating an original image by imaging a pathological specimen and, in that sense, functions as the image acquirer 11. For example, a microscope provided with an imaging function or a device called a slide scanner for scanning an entire specimen at a high speed can be suitably utilized as the imaging device 100.

The image processing device 200 is in charge of various processings for the original image. To this end, the image processing device 200 includes a CPU (Central Processing Unit) 201, a GPU (Graphics Processing Unit) 202, a memory 203, a storage 204, an interface 205 and the like. The CPU 201 realizes various processings such as operations to be described later by executing a control program prepared in advance. The GPU 202 is a processor specialized in parallel computation and performs various computations on image processings.

The memory 203 stores various pieces of data generated in the process of processing in the short term. The storage 204 stores and saves data in a longer term than the memory 203. For example, the control program to be executed by the CPU 201, original image data and data after the image processing and the like are stored in the storage 204.

The interface 205 is in charge of communication with outside. More specifically, the interface 205 has a function of data communication with an external device via the electrical communication line and a function of receiving an operation input from the user via an appropriate input device 206 such as a mouse or a keyboard. That is, the input device 206 and the interface 205 integrally function as a "receiver" for receiving the operation input from the user.

As just described, the respective components of the image processing device 200 are substantially the same as those of a general computer device. Thus, a general-purpose computer device can be utilized as the image processing device 200. The display device 300 includes a display screen such as a liquid crystal display panel and displays an image corresponding to an image signal given from the image processing device 200 on the screen. As is understood from a comparison of FIGS. 1A and 1B, the imaging device 100 corresponds to the image acquirer 11 in this image processing system 1. Further, the image processing device 200 functions as the information acquirer 13 and the image generator 14 by the CPU 201 and the GPU 202 performing processings in accordance with the predetermined control program. Further, the storage 204 corresponds to the storage unit 12. Further, the display device 300 corresponds to the display unit 15.

Note that not all of the components shown in FIG. 1B are essential. For example, if the interface 205 obtains an original image from an external device, the interface 205 functions as the image acquirer 11. Thus, the imaging device 100 is not essential. Further, even a computer device not provided with a GPU can be utilized as the image processing device 200 by causing the CPU 201 to perform computation relating to the image processing. Further, if the interface 205 obtains finding information from an external device, the interface 205 has a function as the information acquirer 13. In this case, the image processing device may not have a function of analyzing the original image and obtaining the finding information.

Further, the imaging device 100, the image processing device 200 and the display device 300 need not necessarily be separate bodies and may be integrated as appropriate. For example, a computer device in which a main body and a display screen are integrated may be utilized as the image processing device 200 and the display device 300. Further, a function as the image processing device 200 may be incorporated into a control device for controlling the imaging device 100 and, further, the display device 300 may also be integrated. In this way, the image processing system 1 can be realized in various forms.

Figure 2:
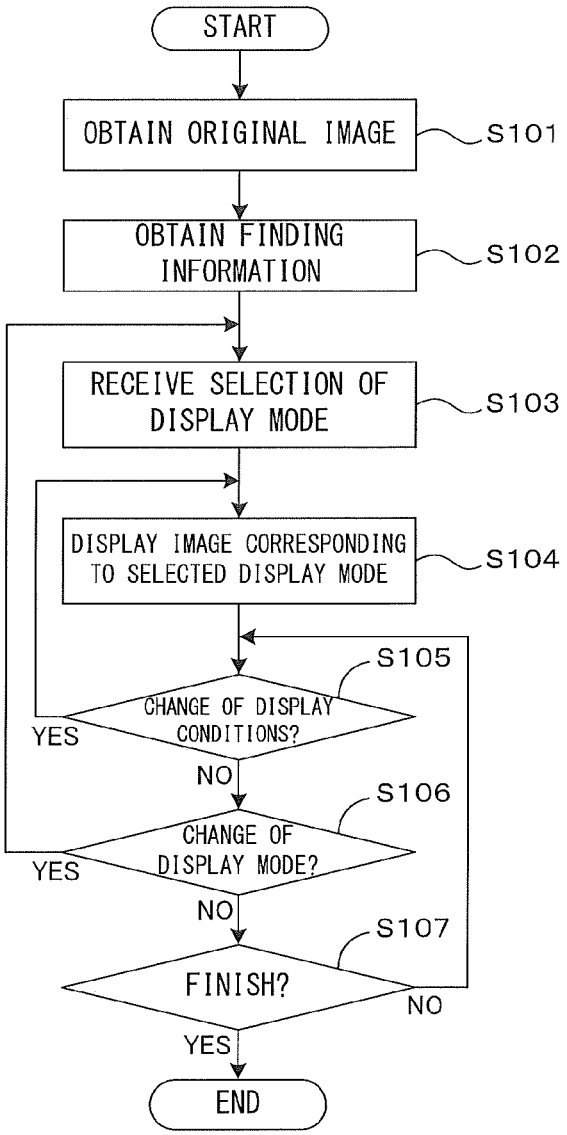
FIG. 2 is a flow chart showing a schematic operation of this image processing system.

FIG. 2 is a flow chart showing a schematic operation of this image processing system. First, an original image captured by imaging a pathological specimen stained with HE is obtained (Step S101). As described above, the original image may be obtained by newly imaging the specimen by the imaging device 100. Further, image data obtained by already performed imaging may be obtained from the imaging device 100 or an external device via the interface 205.

Subsequently, information on pathological findings included in the original image (finding information) is obtained (Step S102). This finding information includes at least information representing positions corresponding to the pathological findings in the original image. As described above, the finding information may be obtained by the information acquirer 13 performing a predetermined image analysis processing for the obtained original image or a result of an already performed analysis may be obtained from an external device via the interface 205. In the case of acquisition from the external device, the finding information may be received together with original image data.

Subsequently, an operation input from a user regarding which of a plurality of display modes prepared in advance is selected is received (Step S103). A message promoting the operation input is displayed on the display device 300. The operation input from the user can be received via the input device 206.

If the display mode is selected in this way, an image corresponding to the selected display mode is displayed on the display device 300 (Step S104). Specifically, the image generator 14 generates an output image corresponding to the selected display mode based on the data of the original image and the finding information saved in the storage unit 12 and outputs the output image to the display unit 15. In this way, the image corresponding to the display mode is displayed on the display device 300 functioning as the display unit 15.

During the display of the image, an operation input from the user regarding a setting change of display conditions and a setting change of the display mode is received as needed (Steps S105, S106). If an operation input regards the setting of the display conditions in one display mode, e.g. a change of a display magnification or a change of an observation position, is received (YES in Step S105), an image reflecting those condition changes is displayed (Step S104). Further, if an operation input regarding a change of the display mode is received (YES in Step S106), a selection input of a new display mode is received and an image is newly displayed in the display mode after the change (Steps S103, S104).

Further, if an operation input to the effect of finishing the display (YES in Step S107), the processing for display is finished. Unless any of these operation inputs is made (NO in Steps S105 to S107), display in the last set mode and display conditions is continued. Display contents and transition modes thereof in each display mode are described with reference to FIGS. 3 to 8B.

Figure 3:
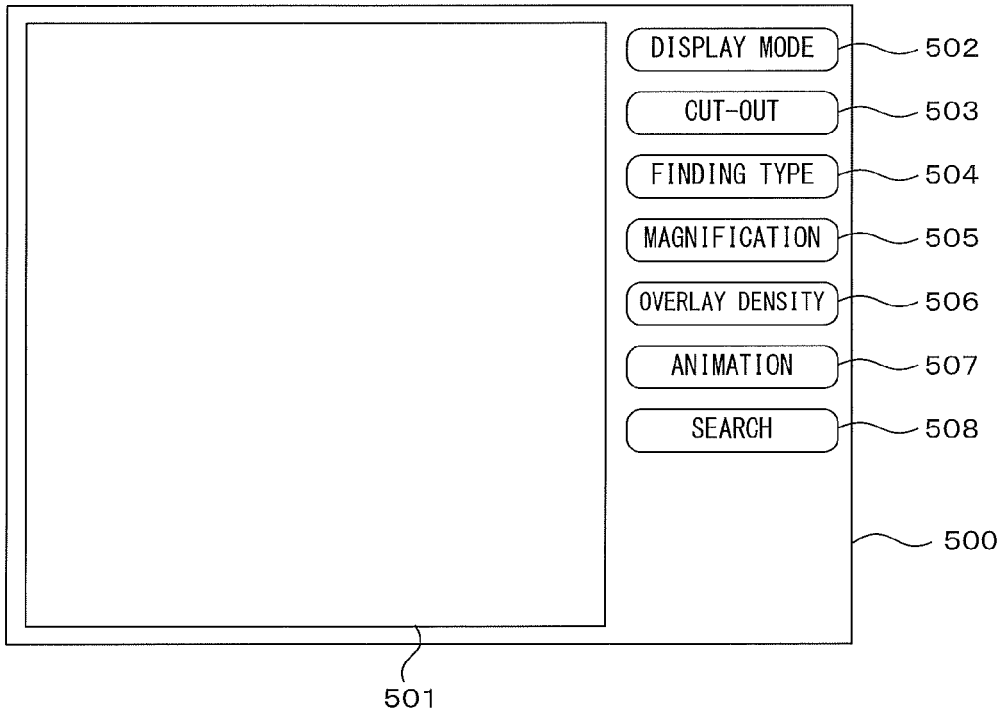
FIG. 3 is a diagram showing a configuration example of a GUI screen in this embodiment.

FIG. 3 is a diagram showing a configuration example of a GUI screen in this embodiment. The output image generated by the image generator 14 is transmitted to the display unit 15 and an image 500 corresponding to the output image is displayed on the display screen of the display unit 15. The image 500 includes a main window 501 for displaying the original image or a processed image generated by processing the original image, and menu buttons 502 to 508 used by the user to designate contents of an image to be displayed in the main window 501. Functions of the respective buttons are described later, using specific examples.

As just described, the operation input of the user using the input device 206 is received via a GUI (Graphical User Interface) screen. Note that an example of the configuration of the menu buttons is shown, and the item names, the arrangement and the like thereof are not limited to this. Further, a reception mode of the operation input is also not limited to this. Further, when the menu button is operated, submenus or other operation buttons may be displayed if necessary. As just described, the GUI screen having an arbitrary configuration can be used.

One or more images such as an original image 511 to be described next, a small image partially cut out from the original image 511 and an image obtained by adding visual information to these images are displayed in the main window 501. One image having a continuous field of view and arranged in the main window 501 in this way is referred to as an "image element" here.

Figure 4:
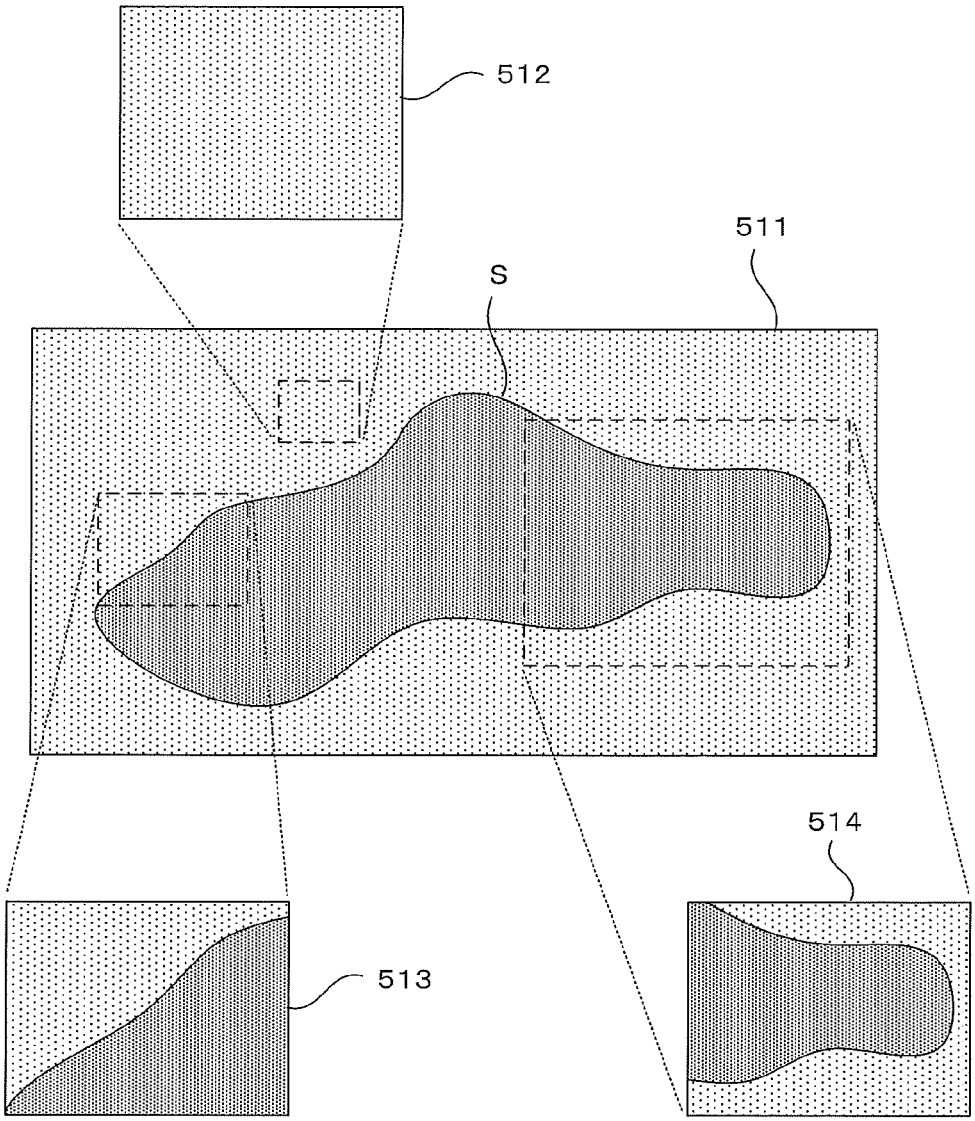
FIG. 4 is a diagram showing a relationship of an original image and source images in this embodiment.

FIG. 4 is a diagram showing a relationship of an original image and source images in this embodiment. The original image 511 is, for example, a whole slide image and captured by imaging an entire pathological specimen S to be pathologically diagnosed. The original image 511 is preferably imaged with a high resolution to deal with a magnification change of the image to be described later.

In contrast, the source images 512 to 514 are obtained by cutting out at least partial regions from the original image 511. A source image of an arbitrary size can be cut out from an arbitrary position in the original image 511. Image contents of the source images 512 to 514 are the same as those of the corresponding regions of the original image 511. That is, the source images 512 to 514 are images in an unprocessed state before a processing to be described later is applied. However, an image size may be appropriately scaled for the convenience of display in the main window 501. The source images 512 to 514 shown in FIG. 4 are respectively different in size occupied in the original image 511, but are scaled to the same size by being appropriately enlarged or reduced in a cut-out state.

The user can designate a cut-out range of the source image from the original image 511 if necessary. More specifically, the user can set and input the source image by selecting a "Cut-Out" menu button 503 corresponding to a cutting-out operation of the source image via the input device 206. If the user designates an arbitrary region in the original image 511 by operating the input device 206, an image in the designated region is cut out as the source image. Further, it is more preferable to provide a function of automatically cutting out source images of suitable sizes according to the surroundings of pathological findings and the display mode selected by the user.

Note that the "processing" to a source image in this embodiment means a processing of overlapping visual information on the source image with a certain level of transparency given to the visual information so that original image contents of the source image can be visually confirmed also in a processed image. A display method, i.e. a so-called overlay display, falls under this. The visual information can include, for example, a color change, color coding, emphasis of a contour or shading of a region, attachment of a marker by a symbol or graphic or character information, or the like. These may be combined as appropriate. Several examples of a processed image and an output image are described below.

Figure 5A:
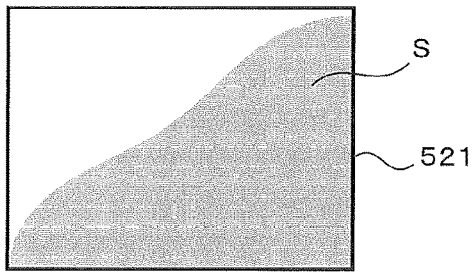
FIGS. 5A to 5D are diagrams showing examples of the processed image in this embodiment.
Figure 5B:
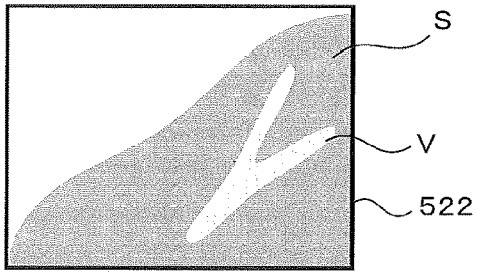
Figure 5C:
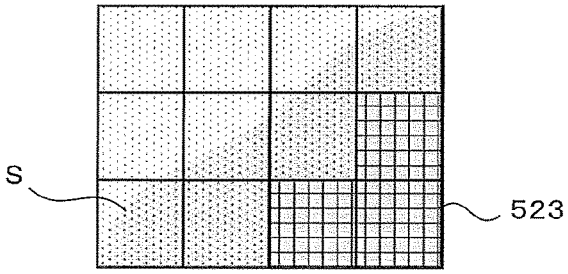

FIGS. 5A to 5D are diagrams showing examples of the processed image in this embodiment. FIG. 5A shows the source image 521 before the processing is applied. This source image 521 is, for example, an image equivalent to the source image 513 cut out from the original image 511 shown in FIG. 4. Here, it is assumed that the pathological specimen S relates to a brain tumor. FIGS. 5B and 5C are examples of the processed image in which a pathological finding extracted in the source image 521 is superimposed and displayed as visual information on the source image 521 based on already obtained finding information.

More specifically, a processed image 522 shown in FIG. 5B is an example of an image obtained by applying a processing of clearly showing a region occupied by a blood vessel V extracted as the pathological finding pixel by pixel to the source image 521. The processing can be realized, for example, by coloring this region with a unique color different from colors of other regions. By performing such a processing, the position occupied by the specific pathological finding (blood vessel in this example) in the image can be clearly shown.

On the other hand, a processed image 523 shown in FIG. 5C is an example of an image obtained by dividing the source image 521 into a plurality of blocks and giving a level of cell density of each block as visual information. In FIG. 5C, the level of cell density is expressed, using the types of hatching and dotting in each block as the visual information. However, on an actual screen, the colors of the blocks can be made different, for example, according to the levels of cell density in the blocks.

Besides information representing the positions of individual structures such as cells, information representing a property of the specimen in a certain region may be used as the finding information. For example, the cell density in the block can be calculated by an image analysis and this can be used as the finding information. Specifically, the visual information may be superimposed on the source image not only as information representing the positions of the pathological findings, but also as various pieces of quantitative information of the pathological findings obtained by an analysis or information representing an evaluation result (e.g. estimation result on histological classification) and the like based on pathological finding values. The GPU 202 can be effectively utilized for such a block-by-block computational processing.

Figure 5D:
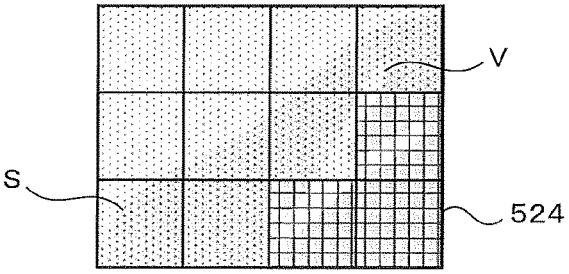

A processed image 524 shown in FIG. 5D is an example of an image on which the above two pieces of the visual information are superimposed. Specifically, the image representing the blood vessel V and the color coding representing a magnitude of the cell density are superimposed on the processed image 524. By making the visual information transparent, the visual information corresponding to a plurality of pathological findings can be shown in the same image as just described. In this way, observation and evaluation from a plurality of perspectives can be easily performed. The user can designate the type of the pathological findings for which the visual information is displayed, using a "Finding Type" menu button 504.

Several display modes that can be selected through the operation input by the user are described below. The display modes for displaying various images in the main window 501 can include, for example, a display mode for displaying the original image 511 shown in FIG. 4 as it is as an image element and a display mode for displaying any one or more of the source image 521 and the processed images 522 to 524 shown in FIGS. 5A to 5D as image element(s). Besides these, the following display modes can be, for example, included. The user can select the display mode by using a "Display Mode" menu button 502.

Figure 6:
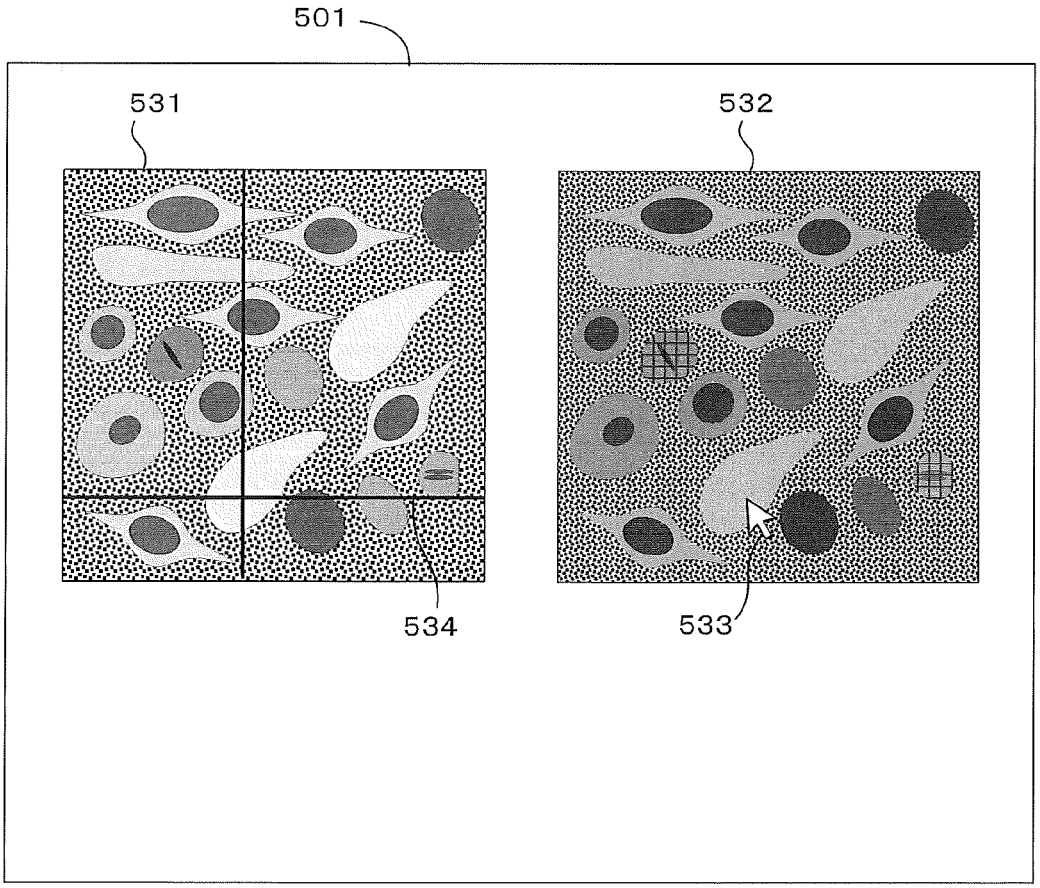
FIG. 6 is a diagram showing examples of images in a first display mode of this embodiment.

FIGS. 6 and 7A to 7C are diagrams showing examples of images in a first display mode of this embodiment. In this display mode, a source image and a processed image added with visual information thereon are displayed side by side as two image elements in the main window 501. A source image 531 in the example shown in FIG. 6 is obtained by enlarging a relatively narrow range of the original image 511 at a high magnification. The enlargement magnification is so selected that the shapes and textures of individual pathological findings in a specimen can be seen. For example, if cell division images are displayed as pathological findings, the enlargement magnification is so selected that one side of the source image 531 represents a length corresponding to a size of about ten cells. Since the size of human body cells is generally about 10 μm, the source image 531 may be, for example, so set that one side thereof is equivalent to 100 μm. Further, in the case of displaying a pathological finding including a plurality of cells, e.g. a blood vessel, such a source image 531 that one side is about equivalent to 500 μm can be used so that a wider range can be displayed. The user can designate the enlargement magnification by using a "Magnification" menu button 505. The user can display an image at a desired magnification according to a purpose or according to the size of an observation target.

A processed image 532 obtained by adding the visual information to the source image 531 is displayed lateral to the source image 531. The processed image 532 in this example is obtained by coloring the cells undergoing cell division as the pathological findings with a unique color as the visual information. In FIG. 6, the visual information is expressed by hatching instead of coloring. As compared to the source image 531, it is understood that cells showing a sign of cell division are present in hatched regions.

When the images in the same field of view are displayed side by side in a single window in this way, markers indicating mutually corresponding positions are preferably displayed. Specifically, if the user operates a mouse as the input device 206, a pointer 533 in the processed image 532 indicated by a white arrow accordingly moves in the screen. At this time, a position marker 534 indicating a corresponding position is displayed at a position indicated by the pointer 533 in the processed image 532 in the source image 531. In this example, crosshairs are used as the position marker 534. An intersection of a longitudinal line drawn in a vertical direction and a lateral line drawn in a horizontal direction in the image represents the indicated position of the pointer 533 in the processed image 532. If the pointer 533 moves in the screen, the intersection of the position marker 534 moves accordingly.

On the other hand, if the pointer 533 is placed in the source image 531, the position marker 534 is displayed at a corresponding position in the processed image 532. By doing so, the positions corresponding to each other can be shown between two images. Since at which position of another image a point focused by the user in one image is located is clearly shown by this function, the user can easily compare the two images. Further, by displaying the pointer 533, with which the position is directly designated by the user operation, and the position marker 534 indicating the position corresponding to the former position in different modes, the user can easily recognize a content of the operation performed by himself. Note that distinction may be made, for example, by making the colors of pointers different.

The visibility of the visual information superimposed on the source image is improved as the density of the visual information increases. On the other hand, if the visual information has a high density, it makes the contents of the source image behind difficult to see. To deal with this problem, it is, for example, thought to switch on and off the addition of the visual information. However, in the case of switching the display from a state where the visual information having a high visibility is added to the source image to a state where the visual information is completely erased, the user possibly misses the position where the visual information was added.

Figure 7A:
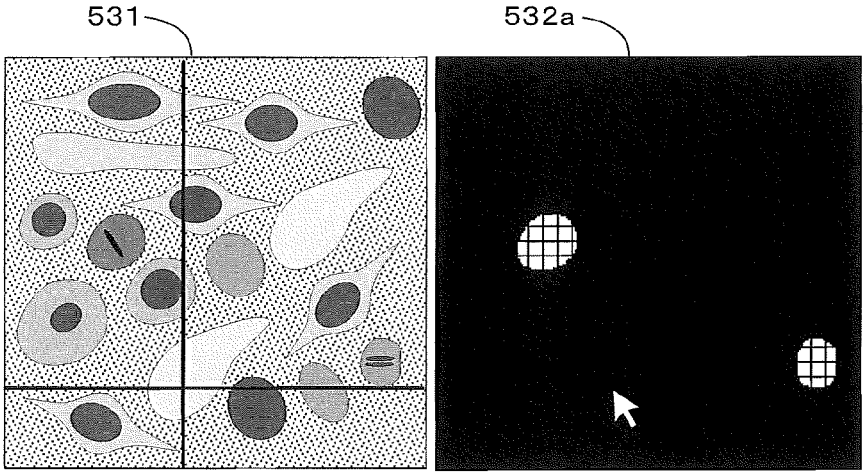
FIGS. 7A to 7C are diagrams showing examples of images in a first display mode of this embodiment.
Figure 7B:
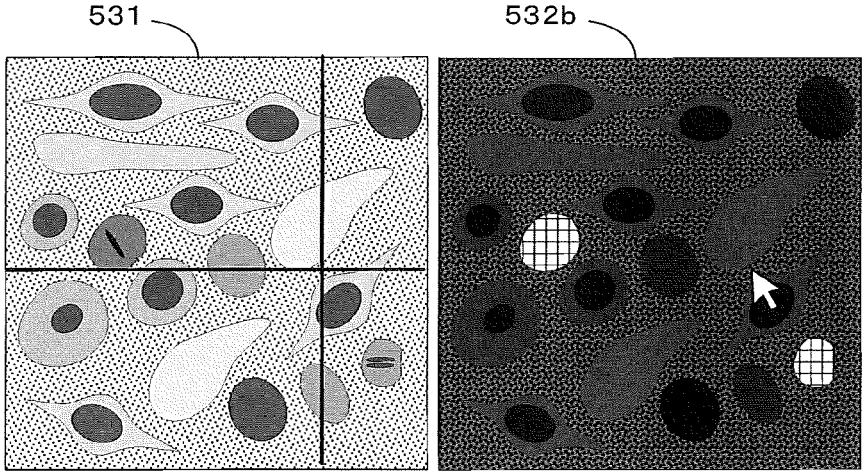
Figure 7C:
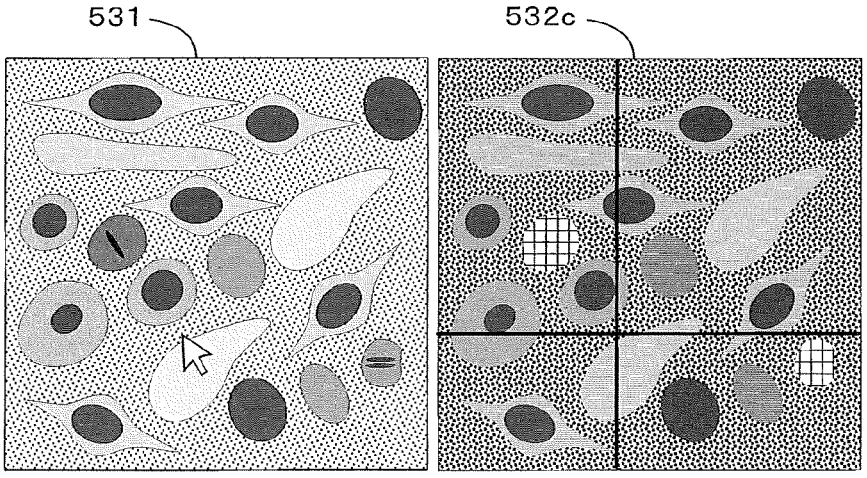

Accordingly, in this embodiment, a display mode is employed in which a relative density ratio of the source image and the visual information to be superimposed on the source image is changed in multi-stages equal to or more than three stages or continuously. Specifically, if the user operates an "Overlay Density" menu button 506, an overlay density, i.e. a relative density between the source image and the visual information in the processed image 532 changes as shown in FIGS. 7A to 7C. Specifically, in a processed image 532*a* shown in FIG. 7A, a luminance of the source image 531 is largely reduced, and image contents thereof can be hardly visually confirmed. In a processed image 532*b* shown in FIG. 7B and a processed image 532*c* shown in FIG. 7C, the luminance of the source image 531 is increased in a stepwise manner, whereas a luminance of the visual information is reduced. In the processed image 532*a*, whether or not the visual information is added is clearly shown, whereas the information of the source image is almost lost. In contrast, in the processed images 532*c*, the information of the source image is clearly left, but the visual information is less conspicuous. The processed image 532*b* has an intermediate property.

As just described, by making the density ratio of the source image and the visual information changeable according to the user operation and successively changing the display according to the change of the density ratio, both image information of the source image and the visual information can be easily confirmed. By doing so, the density of the visual information is changed in a stepwise manner or continuously with respect to the source image. Therefore, the user more easily grasps a correspondence relationship of the source image and the pathological findings included in the source image as compared to display methods in which the visual information is lost or appears suddenly. A method for changing the density of the visual information with the density of the source image fixed, a method for changing the density of the visual information with the density of the source image fixed, and a method for changing the densities of both the source image and the visual information are available as a method for changing the relative density between the source image and the visual information. Any of these methods may be employed.

A plurality of sets of the source image and the processed image may be displayed in the main window 501. The fields of view or the enlargement magnifications may be different from each other among the plurality of these sets. For example, by displaying images of a plurality of pathological findings, which are of the same type and extracted at different positions, side by side, those can be easily compared and observed. Further, a plurality of processed images may be displayed for one source image. In this case, the plurality of processed images can have the same field of view as the source image and be added with mutually different pieces of visual information. By superimposing pieces of the visual information corresponding to a plurality of types of pathological findings on one image, the image may become difficult to see. In such a case, visibility can be improved by displaying the plurality of processed images added with mutually different pieces of the visual information side by side.

If the plurality of sets of image elements are arranged in one window, it is necessary to distinguish to which set the operation of the user corresponds. To this end, it is, for example, possible to set one set as an active set serving as a target of the user operation and display active image elements in such a manner as to be distinguished from other image elements, e.g. in such a manner as to emphasize the contours of the image elements.

If the plurality of image elements arranged in the main window 501 include the same position in the original image, a position marker indicating the corresponding position is desirably attached to each of the image elements. If there are a plurality of sets of image elements, the position markers may be attached to all of those sets or may be attached only to the active sets.

Figure 8A:
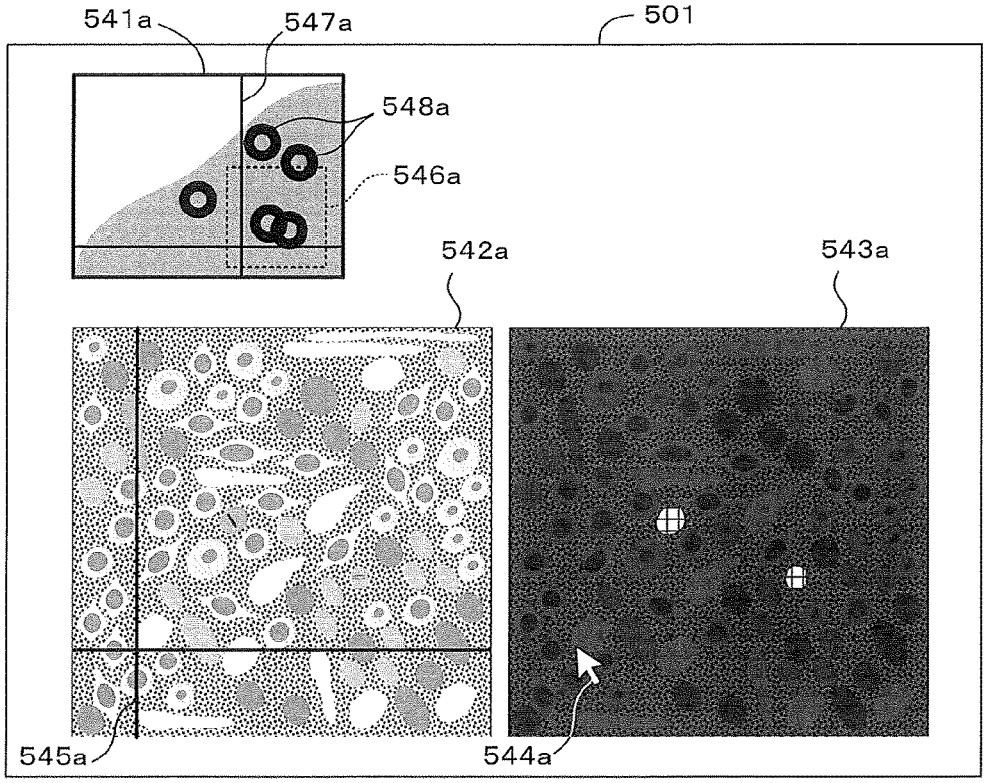
FIGS. 8A and 8B show examples of images in a second display mode of this embodiment.
Figure 8B:
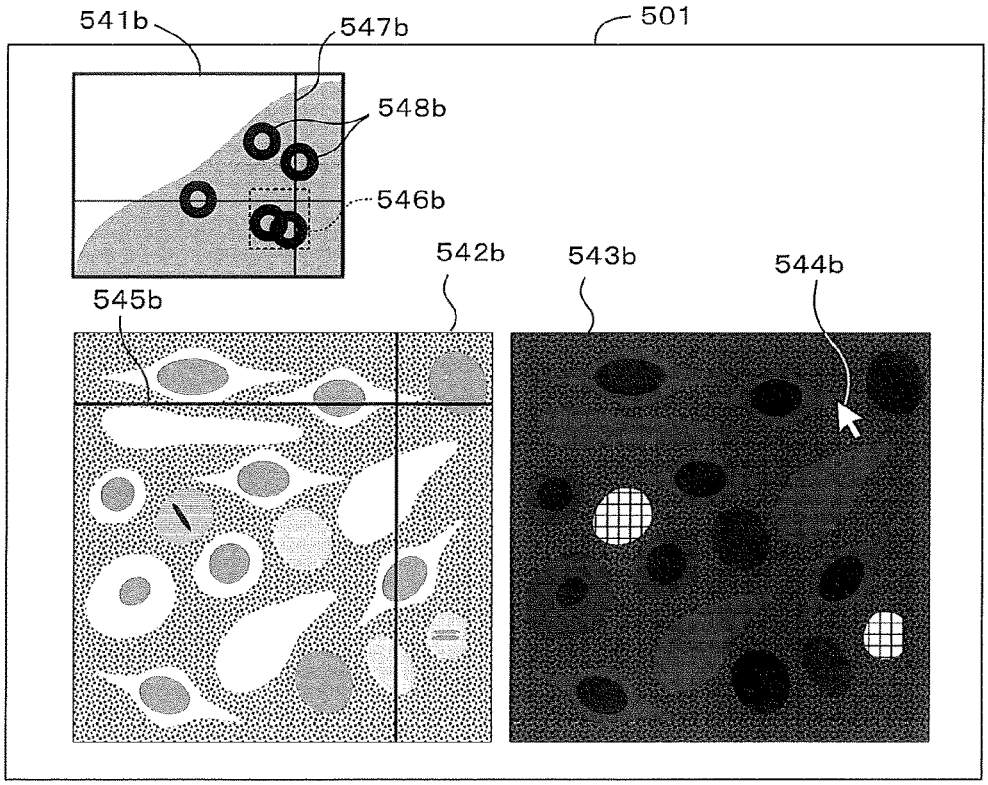

FIGS. 8A and 8B show examples of images in a second display mode of this embodiment. In this display mode, an enlarged image obtained by enlarging a partial region of the original image 511 at a high magnification and a wide range image including a region of the enlarged image and having a lower magnification are displayed in one main window 501. Specifically, as shown in FIG. 8A, a wide range image 541*a* having a relatively low magnification and a wide field of view and an enlarged image 542*a* obtained by enlarging a partial region of the wide range image 541*a* at a high magnification are displayed in the main window 501. The enlarged image 542*a* may be added with visual information. Further, as shown in FIG. 8A, the unprocessed enlarged image 542*a* and a processed image 543*a* obtained from the enlarged image 542*a* as a source image may be displayed side by side.

The processed image 543*a* is an image element showing the positions of cell division as pathological findings extracted in the source image 542*a* by visual information. As in the first display mode, a relative density between the source image and the visual information is desirably changeable by a user operation. Further, a pointer 544*a* indicating a position focused by the user and a position marker 545*a* corresponding to the pointer 544*a* are respectively shown in the enlarged image 542*a* and the processed image 543*a* having the same field of view.

The wide range image 541*a* is at least a part of the original image 511 and an image element having a low magnification and a wide field of view and partially including a region corresponding to the processed image 542*a*. A region marker 546*a* indicating a range of the region corresponding to the enlarged image 542*a* and the processed image 543*a* is superimposed and displayed on the wide range image 541*a*. In this way, the region of the wide range image 541*a* occupied by the enlarged image 542*a* is clearly shown. In addition, a position marker 547*a* indicating the position of the pointer 544*a* is also superimposed and displayed.

When the user changes the field of view by scrolling the enlarged image 542*a* or the processed image 543*a*, the field of view accordingly changes between the enlarged image 542*a* and the processed image 543*a*. Further, associated with this, the position of the region marker 546*a* indicating the region occupied in the wide range image 541*a* also moves. Finding markers 548*a* indicated by circles are superimposed on the wide range image 541*a* as visual information representing the positions of pathological findings (cell division) extracted in the wide range image 541*a*. In this sense, the wide range image 541*a* is also a processed image. A center of the circle of the finding marker 548*a* indicates a representative position of the pathological finding (cell division image in this example). In this way, how the pathological findings are distributed is shown in a wide region including the region of the enlarged image 542*a* and a surrounding region thereof.

In a pathological diagnosis, it is necessary to observe individual pathological findings in detail using the enlarged image 542*a* or the processed image 543*a* thereof, whereas it is necessary to evaluate the pathological findings also in view of a state of distribution of similar findings around the pathological findings. In the second display mode, the wide range image 541*a* and the enlarged image 542*a* obtained by enlarging a part of the wide range image 541*a* or the processed image 543*a* processed using the enlarged image 542*a* as a source image are displayed in one window 501. In addition, the region marker 546*a* indicating the range of the region corresponding to the enlarged image 542*a* and the finding markers 548*a* indicating the positions of the extracted pathological findings are shown in the wide range image 541*a*. Thus, a pathologist as the user can observe the individual pathological findings in detail and also grasp the state of distribution of the pathological findings around the pathological findings.

In the enlarged processed image 543*a*, the regions occupied by the pathological findings in the image are shown by the visual information pixel by pixel. In this way, not only the positions of the pathological findings, but also the sizes and shapes thereof can be shown. On the other hand, if a similar display method is employed also in the wide range image 541*a*, a region occupied in the image becomes too small and a reduction in visibility may be caused. Accordingly, particular sizes and shapes are shown by the processed image 543*a*, and the finding markers 548*a* indicating only the positions of the pathological findings are displayed in the wide range image 541*a*. By emphasizing and displaying the positions using the markers having a higher visibility regardless of the sizes of actual pathological findings in this way, the aforementioned reduction in visibility can be avoided.

The user can change the enlargement magnification of the enlarged image 542*a* using the "Magnification" menu button 505 displayed on the GUI screen (FIG. 3). FIG. 8B shows examples of images when the magnification of the enlarged image was further increased from the state shown in FIG. 8A. By increasing the enlargement magnification, an enlarged image 542*b* represents a partial region of the enlarged image 542*a* at a higher magnification. In conjunction with this, a field of view and a magnification change also in a processed image 543*b*. Further, a pointer 544*b* determined by a user operation and a position marker 545*b* in conjunction with this pointer 544*b* are also displayed in a manner similar to the above.

On the other hand, a field of view and a magnification of a wide range image 541*b* are the same as those of the wide range image 541*a* of FIG. 8A and a display mode of finding markers 548*b* also does not change as a matter of course. However, since a range occupied by the enlarged image 542*b* in the wide range image 541*b* changes by changing the magnification, the size of the region marker 546*b* changes. Further, a position marker 547*b* also changes according to the position of the pointer 544*b*. Note that, depending on the setting of the magnification, the magnification in the enlarged image possibly becomes equal to that in the wide range image.

The enlargement magnification changed and set by the user is stored as a standard magnification in the memory 203 or the storage 204. When the second display mode is selected by a user operation thereafter, the magnification of the enlarged image 542*a* is set at the standard magnification. Since the enlargement magnification set by the user can be estimated to be a magnification suitable for observation, the user needs not adjust the magnification every time by utilizing this magnification as the standard magnification in subsequent displays.

In a state where the magnification is not set by the user, the standard magnification is preferably set, for example, at such a magnification that one entire pathological finding and a region around that pathological finding are accommodated in the enlarged image. The standard magnification in this case may be determined in advance or may be dynamically set according to the size of the pathological finding selected to be displayed.

Also in the second display mode, a plurality of sets of image elements as described above may be arranged in the same window. If the field of view is different among the plurality of sets, a position marker common to those sets needs not be attached. As in the first display mode, position markers may be attached only to active sets or a position marker of a different color may be attached to each set.

On the GUI screen shown in FIG. 3, an "Animation" menu button 507 and a "Search" menu button 508 are provided in addition to those whose functions are already described. Functions realized by the user operating these are described below.

If the "Animation" menu button 507 is selected in the first display mode, animation display is made in which the overlay density, which is changed by the user operation in the above description, automatically changes with time. In this case, the density may change continuously or may change in a stepwise manner at every given time. In such a display mode, a displayed image automatically changes between a state where a source image is clear and a state where visual information is clear. Thus, the user can observe the image without paying attention to the operation.

The "Search" menu button 508 is a function of, if a plurality of pathological findings of the same type are included in the image, automatically searching those in the image and displaying those in a predetermined sequence. For example, if a plurality of cell divisions as pathological findings are extracted in the image, it may be necessary to compare levels of the cell divisions or verify a possibility of erroneous extraction by comparing features of those cell divisions to each other. An enlarged image is suitable for such an observation. However, if a display range of the enlarged image is designated by the user operation for each pathological finding to display the individual pathological findings in the enlarged image, it takes time and it may be difficult to compare the cell divisions to each other by looking away from the image.

The positions of the individual pathological findings are known from the finding information. Utilizing this, the positions of the other extracted pathological findings are searched and enlarged images thereof are successively switched and displayed by a simple operation of the user or automatically in this embodiment. By doing so, the user can successively observe a plurality of pathological findings without looking away from the main window 501. The enlargement magnification is preferably constant for mutual comparison. Further, if the individual pathological findings are, for example, constantly displayed in centers of the enlarged images, the user can easily compare without almost moving his/her gaze.

There are several ways of thinking about in which sequence the plurality of pathological findings are displayed. Firstly, a sequence based on the extracted positions of the pathological findings is thought. Features of pathological findings present close to each other in a pathological tissue are often similar. From this, if another pathological finding present in the neighborhood is displayed after one pathological finding is displayed, those can be more accurately compared to each other. For example, distances between the respective pathological findings can be calculated from the position coordinates of the respective pathological findings and the pathological findings can be successively displayed from the one having a shortest distance. If the pathological findings are largely spaced apart, the pathological findings may be displayed, for example, based on the order of the coordinate positions in the image.

Secondly, a sequence based on degrees of importance of the pathological findings is thought. Even if the pathological findings are of the same type, the actually extracted pathological findings individually have different states. From morphological features of those pathological findings, there are the pathological having great significance and those not having great significance in a diagnosis. For example, normal blood vessels and blood vessels deeply related to a tumor differ in shape and color. If a degree of importance of each of such pathological findings can be quantitatively expressed, the pathological findings can be successively displayed from the one having a highest degree of importance. By doing so, a diagnosis can be given without confirming the pathological findings thought to have a lower degree of importance by successively observing the pathological findings from those showing, for example, the presence of a tumor. In this way, the efficiency of the diagnosis can be improved and a load on a pathologist can be reduced.

Thirdly, a sequence based on the reliability of the extraction is thought. In pathological findings mechanically extracted by a classification algorithm or the like, it is difficult to make a probability of erroneous extraction zero, but certainty (reliability) can be calculated for individual extraction results. A diagnosis having a higher accuracy can be made and an operation efficiency can be improved by successively displaying the pathological findings from the one having a highest result reliability.

As described above, in this embodiment, an image of a pathological specimen can be displayed in various modes requested at a pathological diagnosis site. Particularly, the positions of pathological findings, a correspondence relationship with a source image and the like can be easily presented by changing a density ratio of visual information to be superimposed and the source image based on an extraction result of the pathological findings according to a user operation.

Further, in the first display mode for displaying a source image and an image processed based on the source image side by side, the user can compare and observe the source image and the processed image. On the other hand, in the second display mode for displaying a wide range image and an enlarged image, which is a part of the wide range image, observation can be made while the details of a specimen and a surrounding state thereof are simultaneously grasped. Since these display modes can be selected by a user operation, the user can observe the pathological specimen from various perspectives. As just described, the image processing system 1 of this embodiment can effectively support a diagnosis operation by a pathologist as the user.

As described above, in the above embodiment, the first display mode corresponds to a "first mode" of the invention, and the second display mode corresponds to a "second mode" of the invention, and each of these constitutes one "processing mode" of the invention.

Note that the invention is not limited to the above embodiment and various changes other than the aforementioned ones can be made without departing from the gist of the invention. For example, the image processing system 1 of the above embodiment includes the imaging device 100, the image processing device 200 and the display device 300. However, an essential part of the invention is contents of the image processing for display. Thus, the invention can also be realized as an image processing device for performing only an image processing without having an imaging function and a display function. For example, a generated output image may be transmitted to an external device via an electrical communication line.

Further, although the input device 206 and the display device 300 are configured as separate bodies in the image processing system 1 of the above embodiment, a touch panel may be, for example, used as one having functions of these.

Further, the image processing of the invention can be performed by incorporating dedicated software into a computer device having a general configuration. Specifically, the invention can be distributed as software described to implement an image processing method of the invention to the computer device. Further, by incorporating this software into an existing imaging device, this imaging device can be caused to function as the image processing device of the invention.

Further, the pathological specimen used in the above embodiment is stained with HE. HE staining is widely used as a staining method of a specimen used in visual observation. Thus, if such a use form as to make a pathological diagnosis by comparing a specimen image and pathological findings extracted from the specimen image is considered, it is very useful to use the specimen image prepared by the staining method accustomed to pathologists as users. On the other hand, for the purpose of merely extracting pathological findings, an image processing technique for extracting pathological findings from an unstained specimen image has also been put to practical use. If this is used, it is not an essential requirement to stain a specimen. However, a stained image remains to be effective as an image to be presented to the user. From this, an image obtained by applying such an image processing as to give a pseudo staining effect to an unstained specimen image may be utilized as an original image or a source image in this embodiment.

Further, also in the case of using a pathological specimen employing a staining method other then HE staining, the invention can be applied. For example, Masson's trichrome staining is a method for staining collagen fibers in a specimen with a specific color. This is mainly used to stain collagen deeply related to a specific disease to make a state of the collagen easily understandable. However, since cytoplasms and cell nuclei are also stained, the pathological specimen can also be utilized as a specimen for extracting pathological findings other than collagen. If such pathological findings are also presented, there is a possibility of making a more minute diagnosis. Even another staining method for making specific parts, structures, substances and the like in a specimen conspicuous can be said to be suitable for pathological specimens applied in this embodiment if this staining method has a certain versatility of including information for specifying other parts and the like.

As the specific embodiment has been illustrated and described above, the image generator may be configured to superimpose visual information for a plurality of pathological findings on one source image in the image processing device according to the invention. According to such a configuration, it is possible to generate an output image suitable to comprehensively observe one image from a plurality of perspectives.

Further, for example, the image generator may be configured to generate an output image in which a plurality of processed images having the same field of view and having mutually different pieces of visual information superimposed thereon are arranged in one screen. According to such a configuration, it can be avoided that the pieces of visual information interfere with each other to make an image difficult to see.

Further, for example, the image generator may be configured such that a relative density between a source image and visual information in a processed image is changeable in multi-stages more than two stages or continuously. According to such a configuration, the source image and the visual information are displayed at various density ratios and the confirmation of the visual information and the confirmation of contents of the source image can be combined.

Further, for example, a magnification of an enlarged image set by an operation input may be stored as a standard magnification and the magnification of the enlarged image when the second display mode is selected thereafter may be set at the standard magnification. According to such a configuration, since the magnification set by the user is used as a standard, the frequency of a magnification setting operation can be reduced and operation efficiency can be improved.

Further, for example, a position marker indicating the same position may be attached to each of a plurality of image elements included in one screen. According to such a configuration, a positional correspondence relationship among the respective image elements becomes clear and the user can efficiently compare those image elements.

Further, for example, the visual information having a higher visibility is used when the magnification of the image to be added with the visual information is low than when the magnification of the image is high. According to such a configuration, it can be prevented that the visual information becomes too small and visibility is impaired in the low magnification image.

Further, for example, the visual information may be so superimposed that image contents of the original image are seen through the visual information. According to such a configuration, the visual information can be added and displayed while the contents of the source image are left.

At least one image element included in one screen may be switched according to an operation input or at every given interval. According to such a configuration, the user can more efficiently compare the switched and displayed image elements.

Further, for example, an output image may further include at least one of quantitative information on pathological findings and information on an evaluation result based on the quantitative information and predetermined evaluation criteria. According to such a configuration, a part of an evaluation operation performed by the user for diagnosis can be replaced and a workload of the user can be reduced.

Further, the image processing method according to the invention may include a display step of displaying an image corresponding to an output image on the screen of the display device. According to such a configuration, the output image can be actually displayed and presented to the user.

Further, for example, an original image may be an image obtained by the bright field imaging of a pathological specimen stained with hematoxylin and eosin (HE). HE staining is widely used since cell nuclei and cytoplasms can be stained separately, but does not make specific disease features visible. Thus, a workload of finding out a part corresponding to a pathological change from an image is large. The invention can effectively support such an operation and reduce a load of the user.

This invention can be suitably applied to a pathological diagnosis made by a pathologist based on an image captured by imaging a pathological specimen and, particularly, effectively support an operation necessary for diagnosis from the aspect of an image processing.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. An image processing apparatus, comprising:

an image acquirer which obtains an original image captured by imaging a pathological specimen;

an information acquirer which obtains finding information relating to pathological finding included in the original image for at least one type of the pathological finding;

an image generator which generates an output image for screen display by using at least a part of the original image as a source image, the output image including a processed image obtained by superimposing visual information corresponding to the pathological finding specified by the finding information on the source image as an image element; and a receiver which receives an operation input from a user, wherein:

the image generator sets a relative density between the source image and the visual information in the processed image according to the operation input and has a plurality of processing modes including a first mode and a second mode for generating the output image, the processing modes being selectable by the operation input;

the first mode is the processing mode for generating the output image in which the source image and the processed image having the same field of view each other are arranged as the image elements on one screen; and the second mode is the processing mode for generating the output image in which a wide range image representing at least a partial region of the original image at a relatively low magnification and an enlarged image representing a partial region in the wide range image at a higher magnification than the wide range image are arranged as the image elements on one screen, the magnification of the enlarged image is changeable by the operation input, at least one of the wide range image and the enlarged image is the processed image and a region marker indicating a region corresponding to the enlarged image is superimposed on the wide range image.

2. The image processing apparatus according to claim 1, wherein the image generator superimposes visual information for a plurality of pathological findings on one source image.

3. The image processing apparatus according to claim 1, wherein the image generator generates the output image in which a plurality of processed images having the same field of view and having mutually different pieces of visual information superimposed thereon are arranged in one screen.

4. The image processing apparatus according to claim 1, wherein the image generator changes a relative density between the source image and visual information in the processed image in multi-stages more than two stages or continuously.

5. The image processing apparatus according to claim 1, wherein a magnification of an enlarged image set by the operation input is stored as a standard magnification and the magnification of the enlarged image when the second display mode is selected thereafter is set at the standard magnification.

6. The image processing apparatus according to claim 1, wherein the image generator generates the output image to which a position marker indicating a same position is attached to each of a plurality of image elements included in one screen.

7. The image processing apparatus according to claim 1, wherein the image generator generates the output image to which the visual information having a higher visibility is used when the magnification of the image to be added with the visual information is low than when the magnification of the image is high.

8. The image processing apparatus according to claim 1, wherein the image generator generates the output image to which the visual information is so superimposed that image contents of the original image are seen through the visual information.

9. The image processing apparatus according to claim 1, wherein the image generator switches at least one image element included in one screen according to the operation input or at every given interval.

10. The image processing apparatus according to claim 1, wherein the image generator generates the output image including at least one of quantitative information on pathological finding and information on an evaluation result based on the quantitative information and predetermined evaluation criteria.

11. An image processing system, comprising:

an imaging device which generates the original image by imaging the pathological specimen;

an image processing device which has a same structure as the image processing apparatus according to claim 1; and a display device which displays an image corresponding to the output image output by the image processing device.

12. An image processing method, comprising:

obtaining an original image captured by imaging a pathological specimen;

obtaining finding information relating to pathological finding in the original image for at least one type of the pathological finding;

receiving an operation input from a user; and generating an output image for screen display by using at least a part of the original image as a source image, the output image including a processed image obtained by superimposing visual information representing positions of the pathological finding specified by the finding information on the source image as an image element, wherein:

a relative density between the source image and the visual information in the processed image is set according to the operation input;

a processing mode for generating the output image is selected from a plurality of processing modes including a first mode and second mode by the operation input;

the first mode is the processing mode for generating the output image in which the source image and the processed image having the same field of view each other are arranged as the image elements on one screen; and the second mode is the processing mode for generating the output image in which a wide range image representing at least a partial region of the original image at a relatively low magnification and an enlarged image representing a partial region in the wide range image at a higher magnification than the wide range image are arranged as the image elements on one screen, the magnification of the enlarged image is changeable by the operation input, at least one of the wide range image and the enlarged image is the processed image and a region marker indicating a region corresponding to the enlarged image is superimposed on the wide range image.

13. The image processing method according to claim 12, further comprising displaying an image corresponding to an output image on the screen of a display device.

14. The image processing method according to claim 12, wherein the original image is an image obtained by a bright field imaging of the pathological specimen stained with hematoxylin and eosin.

* * * * *